United States Patent [19]

Djenguerian et al.

[11] Patent Number: 5,038,053

[45] Date of Patent: Aug. 6, 1991

[54] TEMPERATURE-COMPENSATED INTEGRATED CIRCUIT FOR UNIFORM CURRENT GENERATION

[75] Inventors: Alex B. Djenguerian, San Jose; Ramanatha V. Balakrishnan, Saratoga, both of Calif.

[73] Assignee: Power Integrations, Inc., Mountain View, Calif.

[21] Appl. No.: 497,996

[22] Filed: Mar. 23, 1990

[51] Int. Cl.[5] ..... G05F 3/08

[52] U.S. Cl. ..... 307/310; 307/491; 323/315

[58] Field of Search ..... 307/310, 491, 570, 296.7; 323/315, 316, 907, 317

[56] References Cited

U.S. PATENT DOCUMENTS 4,323,854 4/1982 Hester ..... 307/296.6
4,381,484 4/1983 Jarrett ..... 323/315
4,587,478 5/1986 Kasperkovitz et al. ..... 307/310
4,786,856 11/1988 Metcalf et al. ..... 323/315
4,792,748 12/1988 Thomas et al. ..... 323/907

*Primary Examiner*—Stanley D. Miller
*Assistant Examiner*—Scott A. Quellette
*Attorney, Agent, or Firm*—Thomas E. Schatzel

[57] ABSTRACT

An integrated circuit has a first resistor and a second resistor. A base-emitter voltage differential is maintained across the first resistor to develop a first resistor current and a base-emitter voltage is maintained across the second resistor to develop a second resistor current. The first resistor current is mirrored and the second resistor current is subtracted from the mirrored current to obtain a reference current. The resistors have resistance values so that the products of each resistor current multiplied by its temperature coefficient are equal. The resulting reference current is temperature independent.

4 Claims, 1 Drawing Sheet

TEMPERATURE-COMPENSATED INTEGRATED CIRCUIT FOR UNIFORM CURRENT GENERATION

BACKGROUND OF THE INVENTION

1. Field of the Invention

This invention relates to electrical current regulation. More specifically, it concerns an integrated circuit that is temperature-compensated for generation of a uniform reference current.

2. Description of the Prior Art

It has been difficult to provide temperature independent current sources from an integrated circuit because of large positive temperature coefficients of high value diffused/ion implanted resistors. Such resistors heat up during operation and the current varies with temperature. To overcome this difficulty, an external resistor has been used with an internal reference such as a bandgap regulator or a zener diode. This approach provides a low temperature coefficient and a good absolute value, but requires an extra pin and component.

Another approach has been to use low temperature coefficient resistors on an integrated circuit chip instead of an external resistor. This approach has several disadvantages. The lowest temperature coefficient of diffused or ion-implanted resistors that are obtainable in a practical process is too high for current references. Low temperature coefficient resistors are low in value per area unit and thus, large areas are required for typical current values in the micro-ampere to milli-ampere range. High concentration diffusions used for low value resistors are not controlled for absolute value.

It is desirable to use integrated circuits including diffused resistors for providing a current source, but until this time, the problem of uniform current generation over a wide range of temperatures remained to be solved.

SUMMARY OF THE PRESENT INVENTION

An object of the present invention is to provide an integrated circuit that is temperature-compensated for generation of a uniform reference current.

Another object of the invention is to provide a temperature independent current source from resistors having temperature coefficients above 3000 ppm/° C.

A further object of the invention is to provide an integrated circuit as a source of current having a substantially constant value over a wide temperature range.

In a preferred embodiment, a base-emitter voltage differential is maintained across a first resistor to develop a first resistor current. A base-emitter voltage is maintained across a second resistor to develop a second resistor current. The first resistor current is mirrored and the second resistor current is subtracted from the mirrored current to obtain a reference current. The resistors have resistance values so that the products of each resistor current multiplied by its total temperature coefficient are equal. Thus, the reference current developed by the circuit is temperature independent.

Advantages of the invention include an integrated circuit that is temperature-compensated for generation of a uniform reference current, use of resistors having temperature coefficients above 3000 ppm/° C., and the reference current generated having a substantially constant value over a wide temperature range.

These and other objects and advantages of the present invention will no doubt become obvious to those of ordinary skill in the art after having read the following detailed description of the preferred embodiment which is illustrated in the various drawing figures.

IN THE DRAWINGS

FIG. 1 is an electrical diagram of an integrated circuit embodying the present invention; and FIG. 2 is a current/temperature graph illustrating currents produced by one example of an integrated circuit of the type shown in FIG. 1.

DESCRIPTION OF THE PREFERRED EMBODIMENT

Figure 1:
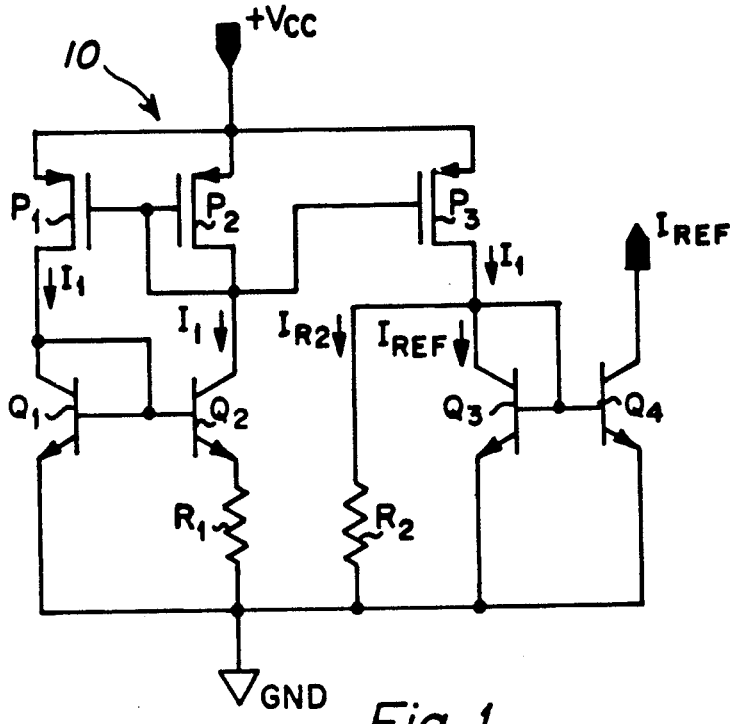

Looking now at FIG. 1, a temperature-compensated integrated circuit is indicated by general reference numeral 10. The circuit is connected between a potential $+V_{cc}$ and a ground GND. This circuit generates a reference current $I_{ref}$. Transistors $P_1$, $P_2$ and $P_3$ are matched current sources with high output impedance. These transistors can be either p-channel MOS field effect type or PNP bipolar junction type. Transistors $Q_1$ and $Q_2$ are matched. Transistor $Q_2$ has eight times the emitter area of transistor $Q_1$. Transistors $Q_3$ and $Q_4$ are matched, and beta values of the transistors $Q_1$, $Q_2$, $Q_3$ and $Q_4$ are high, above 200. Transistors $Q_1$, $Q_2$, $Q_3$ $Q_4$ are of the NPN bipolar junction type. Resistors $R_1$ and $R_2$ are diffused resistors with each having a temperature coefficient of 7700 ppm/° C. for the example shown.

Transistors $P_1$ and $P_2$ are sources of currents $I_1$ that are stabilized with the right amount of current by transistors $Q_1$ and $Q_2$ and resistor $R_1$. The resulting current is reflected to transistor $P_3$ that is a source of a mirror current $I_1$ At the drain of transistor $P_3$, the current $I_1$ is split into a current $I_{R2}$ for resistor $R_2$ and a current $I_{ref}$ for transistor $Q_3$. The reference current $I_{ref}$ can be drawn from the integrated circuit 10 at the collector of the transistor $Q_4$.

The same currents $I_1$ through transistors $Q_1$ and $Q_2$ create a base-emitter voltage differential across resistor $R_1$ at room temperature that can be calculated as $$\Delta V_{BE} = V_T \ln \frac{AQ_2}{AQ_1}$$

wherein $V_T = KT/q$ with K representing Boltzmann constant, q representing elementary charge, and T is temperature in Kelvin degrees. ln represents natural logarithm and AQ is transistor emitter area. Accordingly, $\Delta V_{BE} = 26\text{mv} \times \ln 8 = 54\text{mv}$ at room temperature, with a positive temperature coefficient (T.C.) of 3000 ppm/° C. Therefore, $I_1$ still has a negative T.C. of $-7700+3000=-4700$ ppm/° C. Resistor $R_2$ has a T.C. of 7700 ppm/° C. The voltage across $R_2$ is equal to the base-emitter voltage, $V_{BE}$ of $Q_3$ and has a T.C. of $-3000$ ppm/° C. $V_{BE}$ of $Q_3$ at room temperature is typically 600 mv and the T.C. is $-2$mv/° C. or $-3300$ ppm/° C. Thus, the total T.C. for $I_{R2}$ is $-7700-3300$ and equals $-11000$ ppm/° C.

To compensate for current variations due to temperature changes, the resistance values of resistors $R_1$ and $R_2$ are chosen so that the products of each resistor current multiplied by its total temperature coefficient are equal. Since the resulting absolute current variations for $I_1$ and $I_{R2}$ are the same, $I_{ref}$ becomes temperature independent. For example, assume that a constant current $I_{ref}$ of 20 $\mu$A is desired.

$$I_1 - I_{R2} = I_{ref} = 20\ \mu A$$

$$I_{R2} = \frac{4700}{11000} I_1 = 0.427\ I_1$$

$$I_1 - 0.427\ I_1 = 20\ \mu A$$

$$0.573\ I_1 = 20\ \mu A$$

$$I_1 = 34.9\ \mu A$$

$$I_{R2} = 34.9 - 20 = 14.9\ \mu A$$

$$R_1 = \frac{\Delta V_{BE}}{I_1} = \frac{54\ mv}{34.9\ \mu A} = 1.545\ K\Omega$$

$$R_2 = \frac{V_{BE}}{I_{R2}} = \frac{600\ mv}{14.9\ \mu A} = 40.2\ K\Omega$$

Figure 2:
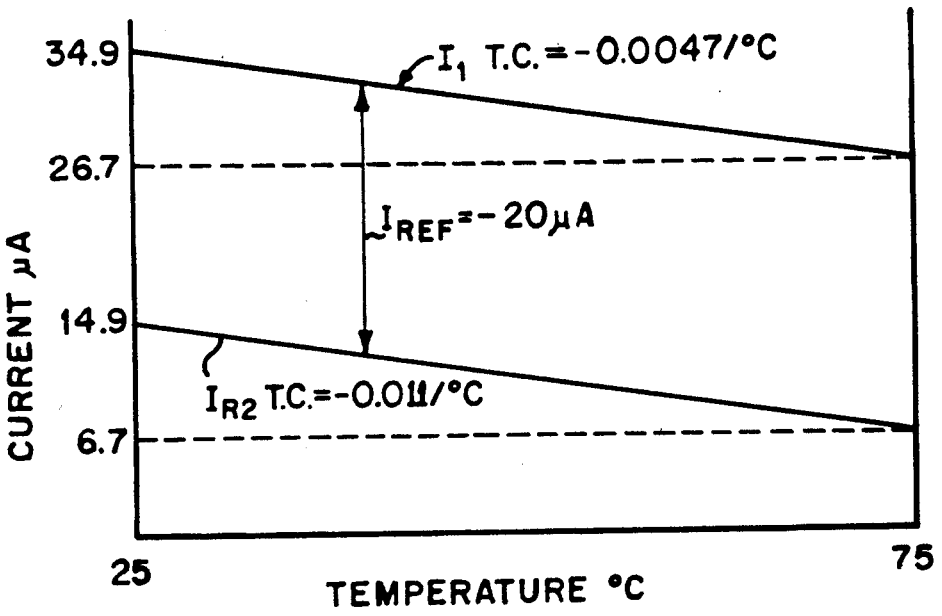

As shown in FIG. 2, the currents $I_1$ and $I_{R2}$ have the same negative slope with temperature increase, and the difference between these currents remains constant representing $I_{ref}$.

From the foregoing description, it will be seen that the integrated circuit 10 has a first resistor $R_1$ A first resistor current $I_1$ is developed by a base-emitter voltage differential maintained across the first resistor by transistor $Q_1$ and $Q_2$ that have different areas and that are supplied with the same currents from transistors $P_1$ and $P_2$. The second resistor $R_2$ is connected in parallel with the transistor $Q_3$ and a base-emitter voltage is maintained across the second resistor to develop a second resistor current $I_{R2}$. The first resistor current $I_1$ is mirrored through transistor $P_3$, and the second resistor current $I_{R2}$ is subtracted from the mirrored current $I_1$ to obtain the reference current $I_{ref}$. The resistors $R_1$ and $R_2$ have resistance values so that the products of each resistor current $I_1$, $I_{R2}$ multiplied by its total temperature coefficient are equal. The reference current $I_{ref}$ developed by the circuit 10 is temperature independent.

Although the present invention has been described in terms of the presently preferred embodiment, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

We claim:

1. A temperature-compensated integrated circuit comprising:

a first resistor, means for maintaining a base-emitter voltage differential across the first resistor to develop a first resistor current, a second resistor, means for maintaining a base-emitter voltage across the second resistor to develop a second resistor current, means for mirroring the first resistor current, and means for subtracting the second resistor current from the mirrored current to obtain a reference current, said resistors having resistance values so that the products of each resistor current multiplied by its total temperature coefficient are equal, whereby the reference current developed by the circuit is temperature independent.

2. The circuit of claim 1 wherein, the means for subtracting the second resistor current from the mirrored current to obtain a reference current includes a pair of matched transistors of the NPN bipolar junction type with the base and collector of the first transistor connected to the base of the second transistor and the emitters connected to ground, the second resistor connected in parallel with the base-emitter junction of the transistors, and a circuit for supplying the mirror current to the parallel resistor/transistor circuit.

3. The circuit of claim 1 wherein, the means for maintaining a base-emitter voltage differential across the first resistor includes a pair of matched NPN bipolar transistors of different emitter areas having bases connected together and emitters connected to opposite ends of the first resistor, and a pair of current source transistors connected to the pair of NPN bipolar transistors.

4. The circuit of claim 3 wherein, the means for mirroring the first resistor current includes a third current source transistor matched with the pair of current source transistors.

* * * * *